US005106717A

United States Patent [19]

Houle et al.

[11] Patent Number: 5,106,717

[45] Date of Patent: Apr. 21, 1992

[54] AB DIBLOCK COPOLYMERS AS TONER PARTICLE DISPERSANTS FOR ELECTROSTATIC LIQUID DEVELOPERS

[75] Inventors: William A. Houle, Kimberton, Pa.; Loretta A. Grezzo Page, Newark, Del.

[73] Assignee: DXImaging, Lionville, Pa.

[21] Appl. No.: 518,034

[22] Filed: May 2, 1990

[51] Int. Cl.[5] ..... G03G 9/13

[52] U.S. Cl. ..... 430/114; 430/115; 430/137

[58] Field of Search ..... 430/114, 115, 137

[56] References Cited

U.S. PATENT DOCUMENTS

| | | | |
|---|---|---|---|
| 4,522,908 | 6/1985 | deWinter et al. | 430/114 |
| 4,599,291 | 7/1986 | Podszün et al. | 430/114 |
| 4,665,011 | 5/1987 | Podszun et al. | 430/114 |
| 4,957,844 | 9/1990 | Page | 430/115 |
| 4,966,825 | 10/1990 | Suzuki et al. | 430/115 |

FOREIGN PATENT DOCUMENTS

| | | |
|---|---|---|
| 0129970A2 | 1/1985 | European Pat. Off. . |
| 0215978A1 | 4/1987 | European Pat. Off. . |
| 0317969A2 | 5/1989 | European Pat. Off. . |
| 0426052A2 | 5/1991 | European Pat. Off. . |
| 1797204 | 12/1970 | Fed. Rep. of Germany . |
| 1244373 | 9/1971 | United Kingdom . |

*Primary Examiner*—John Goodrow

[57] ABSTRACT

Electrostatic liquid developer consisting essentially of (A) a nonpolar liquid having a Kauri-butanol value of less than 30, present in a major amount, (B) thermoplastic resin particles having an average by area particle size of less than 10 μm, and coated with (C), (C) an AB diblock copolymer toner particle dispersant as defined, and (D) a nonpolar liquid soluble ionic or zwitterionic compound. Optionally a colorant and charge adjuvant are present. The process of making the electrostatic liquid developer is described. The electrostatic liquid developer is useful in copying, making proofs including digital color proofs, lithographic printing plates, and resists.

52 Claims, No Drawings

AB DIBLOCK COPOLYMERS AS TONER PARTICLE DISPERSANTS FOR ELECTROSTATIC LIQUID DEVELOPERS

DESCRIPTION

1. Technical Field

This invention relates to electrostatic liquid developers. More particularly this invention relates to electrostatic liquid developers containing AB diblock copolymers as toner particle dispersants.

2. Background Art

It is known that a latent electrostatic image can be developed with toner particles dispersed in a carrier liquid, generally an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid developers comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0, and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, metallic soaps, an aromatic hydrocarbon, etc. to the liquid toner comprising the thermoplastic resin, dispersant nonpolar liquid and preferably a colorant. Such liquid developers provide images of good resolution, but it has been found that charging and image quality are particularly pigment dependent. Some formulations suffer from poor image quality manifested by low resolution, poor solid area coverage, and/or image squash. Further, it has been found that toner sludge forms reducing shelf-life and clogging the machines.

It has been found that the above disadvantages can be overcome and improved developers prepared containing a dispersant nonpolar liquid, a thermoplastic resin, a toner particle dispersant compound of the invention, and preferably a colorant and an adjuvant. The improved electrostatic liquid developer has a better dispersion of toner solids.

SUMMARY OF THE INVENTION

In accordance with this invention there is provided an electrostatic liquid developer consisting essentially of (A) a nonpolar liquid having a Kauri-butanol value of less than 30, present in a major amount, (B) thermoplastic resin particles having an average by area particle size of less than 10 μm, and coated with (C), (C) an AB diblock copolymer toner particle dispersant substantially soluble in component (A), wherein the B block is a polymer substantially soluble in component (A) having a number average molecular weight range of 2,000 to 50,000, and the A block is a trialkyl amino polymer having a number average molecular weight range of 200 to 10,000, the number average degree of polymerization (DP) ratio of the B block to the A block being in the range of 10 to 2 to 100 to 20, and (D) a nonpolar liquid soluble ionic or zwitterionic compound.

In accordance with an embodiment of this invention there is provided a process for preparing an electrostatic liquid developer for electrostatic imaging comprising (A) dispersing at an elevated temperature in a vessel a thermoplastic resin and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media, and (D) adding to the dispersion during or subsequent to Step (A) an AB diblock copolymer toner particle dispersant, wherein the B block is a polymer substantially soluble in component (A) having a number average molecular weight range of 2,000 to 50,000, and the A block is a trialkyl amino polymer having a number average molecular weight range of 200 to 10,000, the number average degree of polymerization (DP) ratio of the B block to the A block being in the range of 10 to 2 to 100 to 20.

DETAILED DESCRIPTION OF THE INVENTION

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvant, e.g., polyhydroxy compound, aminoalcohol, polybutylene succinimide, aromatic hydrocarbon, metallic soap, etc.

Aminoalcohol means that there is both an amino functionality and hydroxyl functionality in one compound.

Conductivity is the conductivity of the developer measured in picomhos (pmhos)/cm at 5 hertz and 5 volts.

Number average degree of polymerization (DP) means the average number of monomeric units per polymer chain. It is related to the number average molecular weight (Mn) by the formula $Mn = Mo \times DP$, where Mo is the molecular weight of the monomer.

The dispersant nonpolar liquids (A) are, preferably, branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point(°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value of less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, and any pigment component present.

Useful thermoplastic resins or polymers include: ethylene vinyl acetate (EVA) copolymers (Elvax ® resins, E. I. du Pont de Nemours and Company, Wilmington, Del.), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, Del., etc., or blends thereof, polyesters, polyvinyl toluene, polyamides, styrene/butadiene copolymers, epoxy resins, acrylic resins, such as a copolymer of acrylic or methacrylic acid (optional but preferred) and at least one alkyl ester of acrylic or methacrylic acid wherein alkyl is 1 to 20 carbon atoms, e.g., methyl methacrylate (50 to 90%)/methacrylic acid (0 to 20%)/ethylhexyl acrylate (10 to 50%); and other acrylic resins including Elvacite ® Acrylic Resins, E. I. du Pont de Nemours and Company, Wilmington, Del., or blends of the resins. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238, Procedure A. Particularly preferred copolymers of this type have an acid number of 66 and 54 and a melt index of 100 and 500 determined at 190° C., respectively.

In addition, the resins have the following preferred characteristics:

1. Be able to disperse the colorant, e.g., pigment, metallic soap adjuvant, etc.,
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 μm and 5 μm, in diameter (preferred size), e.g., determined by Horiba CAPA-500 centrifugal particle analyzer; and between 1 μm and 15 μm in diameter, e.g., determined by Malvern 3600E, which uses laser diffraction light scattering of stirred samples to determine average particle sizes,
5. Be able to form a particle (average by area) of less than 10 μm, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and about 30 μm average particle size, e.g., determined by Malvern 3600E Particle Sizer as described below, and
6. Be able to fuse at temperatures in excess of 70° C.

By solvation in 3. above, the resins forming the toner particles will become swollen, gelatinous or softened.

The dispersant liquid, e.g., nonpolar liquid, soluble AB diblock copolymer toner particle dispersants of the invention (Component (C)) which coat the toner particles comprise a B block which is a polymer that is substantially soluble in the dispersant nonpolar liquid and has a number average molecular weight in the range of about 2,000 to 50,000 and an A block which is a trialkyl amino polymer having a number average molecular weight in the range of about 200 to 10,000, the number average degree of polymerization ratio of the B block to the A block is in the range of 10 to 2 to 100 to 20, preferably 20 to 3 to 40 to 10. The AB polymers can be advantageously produced by stepwise polymerization process such as anionic or group transfer polymerization as described in Webster, U.S. Pat. No. 4,508,880, the disclosure of which is incorporated herein by reference. Polymers so produced have very precisely controlled molecular weights, block sizes and very narrow molecular weight distributions, e.g., weight average molecular weight divided by number average molecular weight. The AB diblock copolymers can also be formed by free radical polymerization wherein the initiation unit is comprised of two different moieties which initiate polymerization at two distinctly different temperatures. However, this method suffers from contamination of the block copolymers with homopolymer and coupled products.

The AB diblock copolymers can also be prepared by conventional anionic polymerization techniques, in which a first block of the copolymer is formed, and, upon completion of the first block, a second monomer stream is started to form a subsequent block of the polymer. The reaction temperatures using such techniques should be maintained at a low level, for example, 0° to −40° C., so that side reactions are minimized and the desired blocks, of the specified molecular weights, are obtained.

More specifically the A block is an alkyl, aryl or alkylaryl amine-containing polymer wherein the alkyl, aryl or alkylaryl moiety which can be substituted or unsubstituted. Substituents on the A block include: nitro, halogen, e.g., Cl; amino, methoxy ($C_2$ to $C_6$), etc. Useful A blocks are polymers prepared from at least one monomer selected from the group consisting of (1) $CH_2{=}CCH_3CO_2R$, (2) $CH_2{=}CHCO_2R$ wherein R in (1) and (2) is alkyl of 1 to 20 carbon atoms where the terminal end of R is of the general formula $N(R^1)_3$, where N is nitrogen, and $R^1$ is alkyl of 1 to 200 carbon atoms, aryl of 6 to 30 carbon atoms, alkylaryl of 7 to 200 carbon atoms, and (3) 2-, 3-, or 4-vinyl pyridine wherein the ring carbon atoms not substituted by the vinyl group may be substituted with $R^1$ and the pyridine nitrogen atom is substituted with $R^1$ wherein $R^1$ is as defined above. Examples of monomers useful in preparing A blocks include: 2-(N,N-dimethylamino)ethyl methacrylate, 2-(N,N-diethylamino)ethyl methacrylate, 4-vinyl pyridine, 2-vinyl pyridine, 3-vinyl pyridine, 2-(t-butylamino)ethyl methacrylate, etc.

Useful B blocks are polymers prepared from at least one monomer selected from the group consisting of butadiene, isoprene and compounds of the general formulas: $CH_2{=}CCH_3CO_2R^2$ and $CH_2{=}CHCO_2R^2$ wherein $R^2$ is alkyl of 8–30 carbon atoms. Examples of monomers useful in preparing B blocks include: 2-ethylhexyl methacrylate, lauryl methacrylate, stearyl methacrylate, butadiene, isoprene, ethylhexyl acrylate, etc.

Useful AB diblock copolymer toner particle dispersants include: poly-2-(N,N-dimethylamino)ethyl methacrylate/polyethylhexyl methacrylate; poly-2-(N,N-diethylamino)ethyl methacrylate/polylauryl methacrylate; poly-2-vinyl pyridine/polyethylhexyl acrylate; poly-4-vinyl pyridine/polybutadiene, poly-2-(N,N-dimethylamino)ethyl methacrylate/polylauryl methacrylate and poly-2-(N,N-diethylamino)ethyl methacrylate/polyethylhexyl methacrylate. The poly-2-(N,N-dimethylamino)ethyl methacrylate/polyethylhexyl methacrylate and poly-2-(N,N-diethylamino)ethyl methacrylate/polyethylhexyl methacrylate diblock copolymer have a number average degree of polymerization ratio of the B block to the A block of 30 to 8. The toner particle dispersant is present in 0.1 to 10,000 milligrams per gram of developer solids, preferably 1 to 1000 milligrams per gram of developer solids.

The optimum AB diblock copolymer toner particle dispersant structure is dependent on the electrostatic liquid developer. To optimize the AB diblock structure the size of the A and B polymer blocks, as well as the ratio between A and B can be changed.

Suitable nonpolar liquid soluble ionic or zwitterionic charge director compounds (D), which are generally used in an amount of 0.25 to 1500 mg/g, preferably 2.5 to 400 mg/g developer solids, include: negative charge directors, e.g., lecithin, Basic Calcium Petronate®, Basic Barium Petronate® oil-soluble petroleum sulfonate, manufactured by Sonneborn Division of Witco Corp., New York, N.Y., alkyl succinimide (manufactured by Chevron Chemical Company of California); positive charge directors, e.g., anionic glycerides such as Emphos® D70-30C, Emphos® F27-85, etc. manufactured by Witco Corp., New York, N.Y., etc.

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

Pigment List

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar® Yellow YT-858-D | Heubach | Yellow 74 |
| Hansa Yellow X | Hoechst | Yellow 75 |
| Novoperm® Yellow HR | Hoechst | Yellow 83 |
| Chromophtal® Yellow 3G | Ciba-Geigy | Yellow 93 |
| Chromophtal® Yellow GR | Ciba-Geigy | Yellow 95 |
| Novoperm® Yellow FGL | Hoechst | Yellow 97 |
| Hansa Brilliant Yellow 10GX | Hoechst | Yellow 98 |
| Lumogen® Light Yellow | BASF | Yellow 110 |
| Permanent Yellow G3R-01 | Hoechst | Yellow 114 |
| Chromophtal® Yellow 8G | Ciba-Geigy | Yellow 128 |
| Irgazin® Yellow 5GT | Ciba-Geigy | Yellow 129 |
| Hostaperm® Yellow H4G | Hoechst | Yellow 151 |
| Hostaperm® Yellow H3G | Hoechst | Yellow 154 |
| L74-1357 Yellow | Sun Chem. | Yellow 14 |

-continued

Pigment List

| Pigment Brand Name | Manufacturer | Colour Index Pigment |
|---|---|---|
| L75-1331 Yellow | Sun Chem. | Yellow 17 |
| L75-2337 Yellow | Sun Chem. | Yellow 83 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black (Blackness Index 155) |

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used alone or in combination with the colorant. Metal particles can also be added.

Another additional component of the electrostatic liquid developer is an adjuvant which can be selected from the group consisting of polyhydroxy compound which contains at least 2 hydroxy groups, aminoalcohol, polybutylene succinimide, metallic soap and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc., as described in Mitchell U.S. Pat. No. 4,734,352;

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc., as described in Larson U.S. Pat. No. 4,702,985;

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984;

metallic soaps: aluminum tristearate; aluminum distearate; barium, calcium, lead, and zinc stearates; cobalt, manganese, lead, and zinc linoleates; aluminum, calcium, and cobalt octoates; calcium and cobalt oleates; zinc palmitate; calcium, cobalt, manganese, lead, and zinc naphthenates; calcium, cobalt, manganese, lead, and zinc resinates; etc. The metallic soap is dispersed in the thermoplastic resin as described in Trout, U.S. Pat. Nos. 4,707,429 and 4,740,444; and aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc., as described in Mitchell U.S. Pat. No. 4,631,244.

The disclosures of the above-listed United States patents describing the adjuvants are incorporated herein by reference.

The particles in the electrostatic liquid developer have an average by area particle size of less than 10 μm, preferably the average by area particle size is less than 5 μm as measured by the Horiba instrument described above. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, and dispersant liquid described above. Generally the resin, dispersant nonpolar liquid and optional colorant are placed in the vessel prior to starting the dispersing step. Optionally the colorant can be added after homogenizing the resin and the dispersant nonpolar liquid, Polar liquids, such as those disclosed in Mitchell U.S. Pat. No. 4,631,244, can also be present in the vessel, e.g., up to 100% based on the weight of total developer liquid. The dispersing step is generally accomplished at elevated temperature, i.e., the temperature of ingredients in the vessel being sufficient to plasticize and liquefy the resin but bring below that at which the dispersant nonpolar liquid or polar liquid, if present, degrades and the resin and/or colorant, if present, decomposes. A preferred temperature range is 80° to 120° C. Other temperatures outside this range may be suitable, however, depending on the particular ingredients used. The presence of the irregularly moving particulate media in the vessel is preferred to prepared the dispersion of toner particles. Other stirring means can be used as well, however, to prepare dispersed toner particles of proper size, configuration and morphology. Useful particulate media are particulate materials, e.g., spherical, cylindrical, etc. selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar liquid present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid may be added at any step during the preparation of the liquid electrostatic developers to facilitate grinding or to dilute the developer to the appropriate % solids needed for toning. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

Another instrument for measuring average particles sizes ia a Malvern 3600E Particle Sizer manufactured by Malvern, Southborough, Mass. which uses laser diffraction light scattering of stirred samples to determine average particle sizes. Since these two instrument use different techniques to measure average particle size the reading differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above.

The dilution is normally conducted to reduce the concentration of toner particles to between 0.1 to 15 percent by weight, preferably 0.3 to 3.0, and more preferably 0.5 to 2 weight percent with respect to the dispersant nonpolar liquid. One or more charge director compounds (D) may be added to impart a charge to the liquid electrostatic developer, and one or more AB diblock copolymer compounds (C), of the type set out above, can be added to disperse the liquid electrostatic developer solids. The addition may occur at any time during the process; preferably at the end of the process; e.g., after the particulate media, if used, are removed and the dilution of toner particles is accomplished. If a diluting dispersant nonpolar liquid is also added, the AB diblock copolymer compound can be added prior to, concurrently with, or subsequent thereto. If an adjuvant compound of a type described above has not been previously added in the preparation of the developer, it can be added prior to or subsequent to the developer being charged.

Other process embodiments for preparing the electrostatic liquid developer include:

(A) dispersing a thermoplastic resin and optionally a colorant and/or adjuvant in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15 percent by weight with respect to the liquid; and (F) adding to the dispersion an ionic or zwitterionic charge director compound and an AB diblock copolymer compound of the invention; and (A) dispersing a thermoplastic resin and optionally a colorant and/or adjuvant in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, (F) adding additional nonpolar liquid, polar liquid or combinations thereof to reduce the concentration of toner particles to between 0.1 to 15 percent by weight with respect to the liquid; and (G) adding to the dispersion an ionic or zwitterionic charge director compound and an AB diblock copolymer compound of the invention.

The AB diblock copolymer toner particle dispersants of this invention are capable of coating toner particles and dispersing electrostatic liquid developers. The synthetic AB diblock copolymers are advantageous because their molecular weight, the amount of amine present, and the ratio of the amine block to the carrier liquid soluble block can be reproducibly controlled, which allows for superior batch to batch reproducibility of toner particle dispersants whose structures are selected for optimum developer performance. The AB diblock copolymers are prepared with high purity and very low toxicity. The electrostatic liquid developers demonstrate good image quality, resolution, solid area coverage, and toning of fine details, evenness of toning, reduced squash independent of the pigment present and also have reduced toner sludge formation. The developers of this invention are useful in copying, e.g., making office copies of black and white as well as various colors; or color proofing, e.g., a reproduction of an image using the standard colors: yellow, cyan, magenta together with black as desired. In copying and proofing the liquid developer is applied to a latent electrostatic image. Other uses envisioned for the electrostatic liquid developers include: digital color proofing, lithographic printing plates, and resists.

The following controls and examples wherein the parts and percentages are by weight illustrate but do not limit the invention. In the examples the melt indices were determined by ASTM D 1238, Procedure A, the average particle sizes by area were determined by a Horiba CAPA-500 centrifugal particle analyzer or a Malvern Particle Sizer as described above, the conductivity was measured in picomhos/cm (pmhos) at 5 hertz and low voltage, 5 volts, and the density was measured using a McBeth densitometer model RD918. The resolution is expressed in the examples in line pairs/mm (lp/mm). Weight average molecular weight can be determined by gel permeation chromatography (GPC). Number average molecular weight can be determined by known osmometry techniques.

The AB diblock copolymers of the invention to be used in the Examples are prepared as follows:

A reaction vessel was charged with 1700 g toluene, 1.0 g xylene, 43.8 g (0.25 mol) 1-ethoxy-1-trimethylsiloxy-2-methylpropene ("initiator"), and 6.0 mL of 0.33 M tetrabutylammonium-3-chlorobenzoate in acetonitrile/THF ("catalyst"). Two feeds were begun simultaneously; 1485 g (7.5 mol) 2-ethylhexyl methacrylate (EHMA) were added over 30 minutes, and 6.0 ml catalyst in 4 g toluene were added over 90 minutes. Reaction of EHMA was followed by high pressure liquid chromatography. After all the EHMA had reacted (twenty minutes after the addition of the EHMA), 314.0 g (2.0 mol) of 2-(N,N-dimethylamino)ethyl methacrylate (DMAEM) were added over 10 minutes. Forty minutes after the addition of DMAEM, all the DMAEM monomer had reacted, and 40 ml of methanol were added to quench. The polymer formed was the diblock poly-2-(N,N-dimethylamino)ethyl methacrylate-co-poly-2-ethylhexyl methacrylate, DP B block to A block was 30/8.

PREPARATION 2

The procedure of Preparation 1 was repeated with the following exceptions: 1980 g (10 mol) of EHMA were used, instead of 1485 g, 471 g (3.0 mol) DMAEM were used, instead of 314 g. The polymer formed was the diblock poly-2-(N,N-dimethylamino)ethyl methacrylate-co-poly-2-ethylhexyl methacrylate, DP B block to A block was 40/12.

The procedure of Preparation 1 was repeated with the following exceptions: 22 g (125 mmol) of initiator was used, instead of 43.8; 118 g (0.75 mol) of DMAEM was used instead of 314 g. The polymer formed was the diblock poly-2-(N,N-dimethylamino) ethyl methacrylate-co-poly-2-ethylhexyl methacrylate, DP B block to A block was 60/6.

A reaction vessel was charged with 140 grams of toluene and heated to reflux. Two feeds were begun simultaneously; a mixture of 82.5 grams of EHMA and 17.5 grams of DMAEM were added over 150 minutes, and 3.5 grams of 2,2'-azobis(2-methylbutyronitrile) in 10 grams of toluene were added over 180 minutes to initiate the reaction. The solution was refluxed for 2 hours to complete the reaction. The polymer formed was the random copolymer poly-2-(N,N-dimethylamino)ethyl methacrylate-co-poly-2-ethylhexyl methacrylate, DP B block to A block was 30/8.

A yellow liquid developer was prepared by adding 289 g of a copolymer of ethylene (91%) and methacrylic acid (9%), melt index at 190° C. is 500, acid No. is 60, 50 g of a diarylide yellow pigment, Sunbrite® Yellow 14, Sun Chemical, Pigments Division, Cincinnati, Ohio, 3 g of aluminum tristearate, and 1284 g of Isopar®-L to a Union Process 1S attritor, Union Process Co., Akron, Ohio, charged with 0.1857 inch (4.76 mm) diameter carbon steel balls. The mixture was milled at 100° C. for 1 hour, cooled to ambient temperature, an additional 535 g of Isopar®-L were added, and milled for another 3 hours. The average particle size was 7.3 μm measured with a Malvern Particle Sizer. The developer was diluted to 2% solids with additional Isopar®-L. When charged with Basic Barium Petronate® (BBP) at 50 mg BBP/gram of developer solids, the toner particles charge negatively. A drop of developer solution was mixed with one drop of Isopar®-L on a glass slide. Small aggregates of toner particles were easily observed in a light microscope, Fisher Stereomaster II light microscope, Model SPT-ITH at 40×. Image quality was evaluated on a testbed using a photopolymer master similar to that disclosed in Riesenfeld et al. U.S. Pat. No. 4,732,831. The photopolymer master was exposed imagewise with an ultraviolet source through a silver halide film bearing an image pattern. This rendered the exposed areas resistive, while the unexposed areas remained conductive. The photopolymer master was then mounted on a steel drum, and the conductive backing of the film was grounded to the drum. The drum rotated at 2.2 inches/second (5.59 cm/second). The photopolymer master was charged to a surface voltage of +200 +300/−30 V with a scorotron, and the charge decayed to background levels in the conductive areas, thus forming a latent electrostatic image.

This latent electrostatic image was developed 3.6 seconds after charging using a pair of grounded roller toning electrodes gapped 0.01 inch (0.0254 cm) from the surface of the photopolymerizable layer and rotated at 3.9 inches/second (9.906 cm/second) in the direction of the drum rotation, through which the liquid developer was delivered. The developed image was metered with 1.5 inch (3.81 cm) diameter steel roller gapped 0.004 inch (0.0102 cm) from the photopolymerizable layer, rotated at 4.7 inches/second (11.938 cm/second) in the opposite direction of the drum rotation and biased to +80 ±20 V. The developed image was then transferred to Isopar ®-L pre-wetted Textweb paper (Champion Papers, Inc., Stamford, Conn.) at 2.2 inches/second (5.588 cm/second) through a transfer zone defined at the lead edge by a biased conductive rubber roller and at the trailing edge by a corotron. The roller was set at −3.5 kV, the corotron wire current was set at 30±20 microamps, and the corotron housing was grounded. The paper receiver was tacked to the surface of the photopolymerizable layer by the biased conductive rubber roller, and the motion of the drum pulled the paper through the transfer zone. The final transferred image was fused in an oven at 400°–450° F. (204.4°–232.2° C.) for approximately 45 seconds. The density was 1.35, with no image defects observed in the solid areas such as smear or trail. Halftone dots ranging from 2 to 97% were easily observed, resolution was 6 to 8 μm. Settling time for a 1.5% solution to show a clear Isopar ® layer was several hours.

CONTROL 2

A magenta toner was prepared by adding 289 g of a copolymer of ethylene (91%) and methacrylic acid (9%), melt index at 190° C. is 500, acid No. is 60, 50 g of a quinacridone magenta pigment Quindo ® Red R6700, Mobay Corporation, Dyes Pigments Organics Division, Pittsburgh, Pa., 3 g of aluminum tristearate, and 1284 g of Isopar ®-L to a Union Process 1S attritor, Union Process Co., Akron, Ohio, charged with 0.1857 inch (4.76 mm) diameter carbon steel balls. The mixture was milled at 100° C. for 1 hour, cooled to ambient temperature, an additional 535 g of Isopar ®-L were added, and milled for another 3 hours. The average particles size was 7.3 μm measured with a Malvern Particle Sizer. The developer was diluted to 2% solids with additional Isopar ®-L. When charged with Basic Barium Petronate ® at 50 mg BBP/gram of developer solids, the toner particles charge negatively. A drop of developer solution was mixed with one drop of Isopar ®-L on a glass slide. Small aggregates of toner particles were easily observed in a light microscope.

CONTROL 3

A cyan toner was prepared by adding 195 g of a copolymer of ethylene (91%) and methacrylic acid (9%), melt index at 190° C. is 500, acid No. is 60, 50 g of a phthalocyanine cyan pigment, NBD 7010, BASF, Holland, Mich., 5 g of p-toluenesulfonic acid, and 1000 g of Isopar ®-L to a Union Process 1S attritor, Union Process Co., Akron, Ohio, charged with 0.1857 inch (4.76 mm) diameter carbon steel balls. The mixture was milled at 100° C. for 1 hour, cooled to ambient temperature, an additional 673 g of Isopar ®-L were added, and milled for another 1.5 hours. The particle size was 9.6 μm measured with a Malvern Particle Sizer. The developer was diluted to 2% solids with additional Isopar ®-L. When charged with Basic Barium Petronate ® at 50 mg BBP/gram of developer solids, the toner particles charge positively. A drop of developer solution was mixed with one drop of Isopar ®-L on a glass slide. Small aggregates of toner particles were easily observed in a light microscope.

CONTROL 4

A cyan toner was prepared by adding 200 grams of a terpolymer of methyl methacrylate (67%)/methacrylic acid (3%)/ethylhexylacrylate (30%), acid No. 13, 50 grams of a phthalocyanine cyan pigment, NBD 7010, BASF, Holland, Mich., and 1000 grams of Isopar ®-L to a Union Process 1S attritor, Union Process Co., Akron, Ohio, charged with 0.1857 inch (4.76 mm) diameter carbon steel balls. The mixture was milled at 100° C. for 1 hour, cooled to ambient temperature, an additional 673 grams of Isopar ®-L were added, and milling was continued for another 1.25 hours. The particle size was 7.0 μm measured with a Malvern Particle Sizer. The developer was diluted to 2% solids with additional Isopar ®-L. When charged with Basic Barium Petronate ® at 50 mg BBP/gram of developer solids, the toner particles charge positively. A drop of developer solution was mixed with one drop of Isopar ®-L on a glass slide. Small aggregates of toner particles were easily observed in a light microscope.

CONTROL 5

An unpigmented toner was prepared by adding 245 g of a copolymer of ethylene (91%) and methacrylic acid (9%), melt index at 190° C. is 500, acid No. is 60, 5 g of aluminum tristearate and 1000 g of Isopar ®-L to a Union Process 1S attritor, Union Process Co., Akron, Ohio, charged with 0.1857 inch (4.76 mm) diameter carbon steel balls. The mixture was milled at 100° C. for 1 hour, cooled to ambient temperature, an additional 673 g of Isopar ®-L were added, and milled for another 2.0 hours. The average particle size was 7.4 μm measured with a Malvern Particle Sizer. The developer was diluted to 2% solids with additional Isopar ®-L. When charged with Basic Barium Petronate ® at 50 mg BBP/gram of developer solids, the toner particles charge negatively. A drop of developer solution was mixed with one drop of Isopar ®-L on a glass slide. Small aggregates of toner particles were easily observed in a light microscope.

CONTROL 6

A 10% solution in Isopar ®-L was made from the random copolymer prepared as described in Preparation 4. One drop of this solution was mixed with two drops of the developer described in Controls 2 through 4, respectively, and observed in a light microscope. Small aggregates of toner particles were easily observed in a light microscope.

EXAMPLE 1

A 10% solution in Isopar ®-L was prepared from the diblock polymer made as described in Preparation 1. One drop of this solution was mixed with one drop of the developer prepared as described in Control 1 and observed in a light microscope. Finely dispersed toner particles were observed with no evidence of aggregation or flocculation. The developer described in Control 1 was diluted to 1.5% solids and charged to 15 pmhos/cm with Basic Barium Petronate ®. The diblock polymer described in Preparation 1 was added at 33 mg per gram of developer solids. Finely dispersed toner particles were observed with no evidence of aggregation or flocculation. Images made of a halftone target and transferred to paper were comparable to the control, i.e., at density 1.35 there were no defects seen in the solid areas, observed dot range was 2 to 97% or better and resolution was 6 to 8 μm. Settling time to show a clear Isopar ® layer for this developer at 1.5% solids was several weeks.

EXAMPLE 2

A 10% solution in Isopar ®-L was prepared from the diblock polymer made as described in Preparation 2. One drop of this solution was mixed with one drop of the developer prepared as described in Control 1 and observed in a light microscope. Finely dispersed toner particles were observed with no evidence of aggregation or flocculation. The developer described in Control 1 was diluted to 1.5% solids and charged to 15 pmhos/cm with Basic Barium Petronate ®. The diblock polymer described in Preparation 2 was added at 33 mg per gram of developer solids. Finely dispersed toner particles were observed with no evidence of aggregation or flocculation. Images made of a halftone target and transferred to paper were comparable to the control, i.e., at density 1.35 there were no defects seen in the solid areas, observed dot range was 2 to 97% or better and resolution was 6 to 8 μm. Settling time to show a clear Isopar ® layer for this developer at 1.5% solids was several weeks.

EXAMPLE 3

A 10% solution in Isopar ®-L was prepared from the diblock polymer made as described in Preparation 3. One drop of this solution was mixed with one drop of the developer prepared as described in Control 1 and observed in a light microscope. Finely dispersed developer particles were observed with no evidence of aggregation or flocculation. The developer described in Control 1 was diluted to 1.5% solids and charged to 15 pmhos/cm with Basic Barium Petronate ®. The diblock polymer described in Preparation 3 was added at 33 mg per gram of developer solids. Finely dispersed toner particles were observed with no evidence of aggregation or flocculation. Images made of a halftone target and transferred to paper were comparable to the control, i.e., at density 1.35 there were no defects seen in the solid areas, observed dot range was 2 to 97% or better and resolution was 6 to 8 μm. Settling time to show a clear Isopar ® layer for this developer at 1.5% solids was several weeks.

EXAMPLE 4

A 10% solution in Isopar ®-L was made from the diblock polymer prepared as per Preparation 1. One drop of this solution was mixed with the developer prepared as described in Control 2 and observed in a light microscope. Finely dispersed toner particles were observed with no evidence of aggregation or flocculation.

EXAMPLE 5

A 10% solution in Isopar ®-L was made from the diblock polymer prepared as per Preparation 1. One drop of this solution was mixed with two drops of the developer prepared as described in Control 3 and observed in a light microscope. Finely dispersed toner particles were observed with no evidence of aggregation or flocculation.

EXAMPLE 6

A 10% solution in Isopar ®-L was made from the diblock polymer prepared as per Preparation 1. One drop of this solution was mixed with two drops of the developer prepared as described in Control 4 and observed in a light microscope. Finely dispersed toner particles were observed with no evidence of aggregation or flocculation.

EXAMPLE 7

A 10% solution in Isopar ®-L was made from the diblock polymer prepared as per Preparation 2. One drop of this solution was mixed with two drops of the developer prepared as described in Control 5 and observed in a light microscope. Finely dispersed toner particles were observed with no evidence of aggregation or flocculation.

We claim:

1. An improved electrostatic liquid developer consisting essentially of
   (A) a nonpolar liquid having a Kauri-butanol value of less than 30, present in a major amount,
   (B) thermoplastic resin particles having an average by area particle size of less than 10 μm and coated with (C),
   (C) an AB diblock copolymer toner particle dispersant substantially soluble in component (A), wherein the B block is a polymer substantially soluble in component (A) having a number average molecular weight range of 2,000 to 50,000, and the A block is a trialkyl amino polymer having a number average molecular weight range of 200 to 10,000, the number average degree of polymerization (DP) ratio of the B block to the A block being in the range of 10 to 2 to 100 to 20, and
   (D) a nonpolar liquid soluble ionic or zwitterionic compound.

2. An electrostatic liquid developer according to claim 1 wherein the A block of the AB diblock copolymer is a polymer prepared from at least one monomer selected from the group consisting of (1) $CH_2{=}CCH_3CO_2R$, (2) $CH_2{=}CHCO_2R$ wherein R in (1) and (2) is alkyl of 1 to 20 carbon atoms where the terminal end of R is of the general formula $N(R^1)_3$, where N is nitrogen and $R^1$ is alkyl of 1 to 200 carbon atoms, aryl of 6 to 30 carbon atoms, and alkylaryl of 7 to 200 carbon atoms, and (3) 2-, 3-, or 4-vinyl pyridine wherein the ring carbon atoms not substituted by the vinyl group may be substituted with $R^1$ and the pyridine nitrogen atom is substituted with $R^1$ wherein $R^1$ is alkyl of 1-200 carbon atoms.

3. An electrostatic liquid developer according to claim 1 wherein the B block of the AB diblock copolymer is a polymer prepared from at least one monomer selected from the group consisting of butadiene, isoprene, and compounds of the general formulas: $CH_2{=}CCH_3CO_2R^2$ and $CH_2{=}CHCO_2R^2$ wherein $R^2$ is alkyl of 8 to 30 carbon atoms.

4. An electrostatic liquid developer according to claim 1 wherein the AB diblock copolymer toner particle dispersant is selected from the group consisting of poly-2-(N,N-dimethylamino)ethyl methacrylate/polyethylhexyl methacrylate; poly-2-(N,N-diethylamino)ethyl methacrylate/polylauryl methacrylate; poly-2-vinyl pyridine/polyethylhexyl acrylate; poly-4-vinyl pyridine/polybutadiene, poly-2-(N,N-dimethylamino)ethyl methacrylate/polylauryl methacrylate and poly-2-(N,N-diethylamino)ethyl methacrylate/-polyethylhexyl methacrylate.

5. An electrostatic liquid developer according to claim 4 wherein the poly-2-(N,N-dimethylamino)ethyl methacrylate/polyethylhexyl methacrylate AB diblock copolymer has a number average degree of polymerization ratio of the B block to the A block of 30 to 8.

6. An electrostatic liquid developer according to claim 4 wherein the poly-2-(N,N-diethylamino)ethyl methacrylate/polyethylhexyl methacrylate AB diblock copolymer has a number average degree of polymerization ratio of the B block to the A block of 30 to 8.

7. An electrostatic liquid developer according to claim 1 wherein component (A) is present in 85 to 99.9% by weight, based on the total weight of the liquid developer, the total weight of solids is 0.1 to 15% by weight, component (C) is present in 0.1 to 10,000 milligrams per gram of developer solids and component (D) is present in 0.25 to 1,500 milligrams per gram of developer solids.

8. An electrostatic liquid developer according to claim 1 containing up to about 60% by weight of a colorant based on the total weight of developer solids.

9. An electrostatic liquid developer according to claim 8 wherein the colorant is a pigment.

10. An electrostatic liquid developer according to claim 8 wherein the colorant is a dye.

11. An electrostatic liquid developer according to claim 1 wherein a fine particle size oxide is present.

12. An electrostatic liquid developer according to claim 1 wherein an additional compound is present which is an adjuvant selected from the group consisting of polyhydroxy compound, aminoalcohol, polybutylene succinimide, metallic soap, and an aromatic hydrocarbon.

13. An electrostatic liquid developer according to claim 8 wherein an additional compound is present which is an adjuvant selected from the group consisting of polyhydroxy compound, aminoalcohol, polybutylene succinimide, metallic soap, and an aromatic hydrocarbon.

14. An electrostatic liquid developer according to claim 12 wherein a polyhydroxy adjuvant compound is present.

15. An electrostatic liquid developer according to claim 12 wherein an aminoalcohol adjuvant compound is present.

16. An electrostatic liquid developer according to claim 12 wherein a polybutylene succinimide adjuvant compound is present.

17. An electrostatic liquid developer according to claim 12 wherein a metallic soap adjuvant compound is present dispersed in the thermoplastic resin.

18. An electrostatic liquid developer according to claim 12 wherein an aromatic hydrocarbon adjuvant compound having a Kauri-butanol value of greater than 30 is present.

19. An electrostatic liquid developer according to claim 15 wherein the aminoalcohol adjuvant compound is triisopropanolamine.

20. An electrostatic liquid developer according to claim 1 wherein the thermoplastic resin is a copolymer of ethylene and an $\alpha,\beta$-ethylenically unsaturated acid selected from the group consisting of acrylic acid and methacrylic acid.

21. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

22. An electrostatic liquid developer according to claim 8 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

23. An electrostatic liquid developer according to claim 21 wherein the thermoplastic resin is a copolymer of ethylene (89%)/methacrylic acid (11%) having a melt index at 190° C. of 100.

24. An electrostatic liquid developer according to claim 1 wherein the thermoplastic resin component is a copolymer of acrylic or methacrylic acid and at least one alkyl ester of acrylic or methacrylic acid wherein alkyl is 1 to 20 carbon atoms.

25. An electrostatic liquid developer according to claim 24 wherein the thermoplastic resin component is a copolymer of methyl methacrylate (50–90%)/methacrylic acid (0–20%)/ethylhexyl acrylate (10–50%).

26. An electrostatic liquid developer according to claim 1 wherein the particles have an average by area particle size of less than 5 $\mu$m.

27. A process for preparing a electrostatic liquid developer for electrostatic imaging comprising (A) dispersing at an elevated temperature in a vessel a thermoplastic resin, and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 $\mu$m from the particulate media, and (D) adding to the dispersion during or subsequent to Step (A) a nonpolar liquid soluble ionic or zwitterionic charge director compound and an AB diblock copolymer substantially soluble in component (A), wherein the B block is a polymer substantially soluble in component (A) having a number average molecular weight in the range of about 2,000 to 50,000, and the A block is a trialkyl amino polymer having a number average molecular weight in the range of about 200 to 10,000, the number average degree of polymerization ratio of the B block to the A block being in the range of 10 to 2 to 100 to 20.

28. A process according to claim 27 wherein the A block of the AB diblock copolymer is a polymer prepared from at least one monomer selected from the group consisting of (1) $CH_2{=}CCH_3CO_2R$, (2) $CH_2{=}CHCO_2R$ wherein R in (1) and (2) is alkyl of 1 to 20 carbon atoms where the terminal end of R is of the general formula $N(R^1)_3$, where N is nitrogen, and $R^1$ is alkyl of 1 to 200 carbon atoms, aryl of 6 to 30 carbon atoms, alkylaryl of 7 to 200 carbon atoms, and (3) 2-, 3-, or 4-vinyl pyridine wherein the ring carbon atoms not substituted by the vinyl group may be substituted with $R^1$ and the pyridine nitrogen atom is substituted with $R^1$ wherein $R^1$ is alkyl of 1-200 carbon atoms.

29. A process according to claim 27 wherein the B block of the AB diblock copolymer is a polymer prepared from at least one monomer selected from the group consisting of butadiene, isoprene and compounds of the general formulas: $CH_2{=}CCH_3CO_2R^2$ and $CH_2{=}CHCO_2R^2$ wherein $R^2$ is alkyl of 8 to 30 carbon atoms.

30. A process according to claim 27 wherein the AB diblock copolymer toner particle dispersants are selected from the group consisting of poly-2-(N,N-dimethylamino)ethyl methacrylate/polyethylhexyl methacrylate; poly-2-(N,N-diethylamino)ethyl methacrylate/-polylauryl methacrylate; poly-2-vinyl pyridine/polyethylhexyl acrylate; poly-4-vinyl pyridine/polybutadiene, poly-2-(N,N-dimethylamino)ethyl methacrylate/-polylauryl methacrylate and poly-2-(N,N-diethylamino)ethyl methacrylate/polyethylhexyl methacrylate.

31. A process according to claim 27 wherein the poly-2-(N,N-dimethylamino)ethyl methacrylate/polyethylhexyl methacrylate AB diblock copolymer has a number average degree of polymerization ratio of the B block to the A block of 30 to 8.

32. A process according to claim 27 wherein the poly-2-(N,N-diethylamino)ethyl methacrylate/polyethylhexyl methacrylate AB diblock copolymer has a number average degree of polymerization ratio of the B block to the A block of 30 to 8.

33. A process according to claim 27 wherein there is present in the vessel up to 100% by weight of a polar liquid having a Kauri-butanol value of at least 30, the percentage based on the total weight of the developer liquid.

34. A process according to claim 27 wherein the particulate media are selected from the group consisting of stainless steel, carbon steel, ceramic, alumina, zirconia, silica and sillimanite.

35. A process according to claim 27 wherein the thermoplastic resin is a copolymer of ethylene and an $\alpha$, $\beta$-ethylenically unsaturated acid selected from the group consisting of acrylic acid and methacrylic acid.

36. A process according to claim 27 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

37. A process according to claim 36 wherein the thermoplastic resin is a copolymer of ethylene (89%)/methacrylic acid (11%) having a melt index at 190° C. of 100.

38. A process according to claim 27 wherein the thermoplastic resin component is a copolymer of acrylic or methacrylic acid and at least one alkyl ester of acrylic or methacrylic acid wherein alkyl is 1 to 20 carbon atoms.

39. A process according to claim 38 wherein the thermoplastic resin component is a copolymer of methyl methacrylate (50-90%)/methacrylic acid (0-20%)/ethylhexyl acrylate (10-50%).

40. A process according to claim 27 wherein additional dispersant nonpolar liquid, polar liquid, or combinations thereof is present to reduce the concentration of toner particles to between 0.1 to 15 percent by weight with respect to the developer liquid.

41. A process according to claim 40 wherein the concentration of toner particles is reduced by additional dispersant nonpolar liquid.

42. A process according to claim 27 wherein cooling the dispersion is accomplished while grinding by means of particulate media to prevent the formation of a gel or solid mass with or without the presence of additional liquid.

43. A process according to claim 27 wherein cooling the dispersion is accomplished without stirring to form a gel or solid mass, followed by shredding the gel or solid mass and grinding by means of particulate media with or without the presence of additional liquid.

44. A process according to claim 27 wherein cooling the dispersion is accomplished with stirring to form a viscous mixture and grinding by means of particulate media with or without the presence of additional liquid.

45. A process according to claim 27 wherein an adjuvant compound selected from the group consisting of polyhydroxy compound aminoalcohol, polybutylene succinimide, metallic soap, and an aromatic hydrocarbon is added during the dispersing step (A).

46. A process according to claim 45 wherein the adjuvant compound is an aminoalcohol.

47. A process according to claim 40 wherein an adjuvant compound selected from the group consisting of polyhydroxy compound, aminoalcohol, polybutylene succinimide, metallic soap, and an aromatic hydrocarbon is added.

48. A process according to claim 47 wherein the adjuvant compound is a polyhydroxy compound.

49. A process according to claim 47 wherein the adjuvant compound is a metallic soap dispersed in the thermoplastic resin.

50. A process according to claim 49 wherein the metallic soap adjuvant compound is aluminium stearate dispersed in the thermoplastic resin.

51. A process for preparing electrostatic liquid developer comprising (A) dispersing a thermoplastic resin and optionally a colorant and/or adjuvant in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 $\mu$m from the particulate media, and (E) adding additional nonpolar liquid, polar liquid or combinations thereof to reduce the concentration of toner particles to between 0.1 to 15 percent by weight with respect to the liquid; and (F) adding to the dispersion a nonpolar liquid soluble ionic or zwitterionic charge director compound and an AB diblock copolymer substantially soluble in component (A), wherein the B block is a polymer substantially soluble in Component (A) having a number average molecular weight in the range of about 2,000 to 50,000, and the A block is a trialkyl amino polymer having a number average molecular weight in the range of about 200 to 10,000, the number average degree of polymerization ratio of the B block to the A block being in the range of 10 to 2 to 100 to 20.

52. A process for preparing electrostatic liquid developer comprising (A) dispersing a thermoplastic resin and a colorant and/or adjuvant in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, (F) adding additional nonpolar liquid, polar liquid or combinations thereof to reduce the concentration of toner particles to between 0.1 to 15 percent by weight with respect to the liquid; and (G) adding to the dispersion a nonpolar liquid soluble ionic or zwitterionic charge director compound and an AB diblock copolymer substantially soluble in component (A), wherein the B block is a polymer substantially soluble in component (A) having a number average molecular weight in the range of about 2,000 to 50,000, and the A block is a trialkyl amino polymer having a number average molecular weight in the range of about 200 to 10,000, the number average degree of polymerization ratio of the B block to the A block being in the range of 10 to 2 to 100 to 20.

* * * * *